US007865985B2

(12) United States Patent
Revenus

(10) Patent No.: US 7,865,985 B2
(45) Date of Patent: Jan. 11, 2011

(54) HYDRAULIC COLUMN CLAMPING

(75) Inventor: Rolf Revenus, Karlsruhe (DE)

(73) Assignee: Maquet GmbH & Co. KG., Rastatt (DE)

( * ) Notice: Subject to any disclaimer, the term of this patent is extended or adjusted under 35 U.S.C. 154(b) by 256 days.

(21) Appl. No.: 11/595,017

(22) Filed: Nov. 9, 2006

(65) Prior Publication Data

US 2007/0101497 A1 May 10, 2007

(30) Foreign Application Priority Data

Nov. 10, 2005 (DE) ..... 10 2005 053 753

(51) Int. Cl.
*A61G 13/04* (2006.01)
*A61G 13/06* (2006.01)

(52) U.S. Cl. ..... 5/614; 5/600; 248/415; 108/139

(58) Field of Classification Search ..... 5/600, 5/601, 611, 614; 248/349.1, 415, 424, 430; 108/137, 139; 40/456, 479; 297/344.22, 297/344.26; 60/477; 97/170 MP
See application file for complete search history.

(56) References Cited

U.S. PATENT DOCUMENTS

| | | | | |
|---|---|---|---|---|
| 566,521 | A | 8/1896 | Leger | |
| 1,740,906 | A | 12/1929 | Rothauszky et al. | |
| 2,416,410 | A | 2/1943 | Shampaine | |
| 2,763,320 | A * | 9/1956 | Schram | 248/404 |
| 2,764,459 | A * | 9/1956 | McDonald | 5/614 |
| 2,771,330 | A | 11/1956 | Zaalberg | |
| 2,775,496 | A | 12/1956 | Berggren | |
| 2,816,806 | A | 12/1957 | Zaalberg | |
| 2,995,762 | A | 8/1961 | Albinson | |
| 3,226,734 | A | 1/1966 | Coventon | |
| 3,238,539 | A | 3/1966 | Koch | |
| 3,302,218 | A | 2/1967 | Stryker | |
| 3,328,079 | A | 6/1967 | Byczkowski et al. | |
| 3,362,704 | A | 1/1968 | Pilz | |
| 3,379,877 | A | 4/1968 | Makino et al. | |

(Continued)

FOREIGN PATENT DOCUMENTS

DE 264297 8/1912

(Continued)

OTHER PUBLICATIONS

European Search Report for Application No. EP 06 12 3444, dated Aug. 22, 2008.

(Continued)

*Primary Examiner*—Shane Bomar
*Assistant Examiner*—Gilbert Y Lee
(74) *Attorney, Agent, or Firm*—McCormick, Paulding & Huber LLP

(57) ABSTRACT

An operating table is shown, which comprises a table column with a column foot (10) and with a column head and also a bed connectable or connected to the column head, the column foot (10) having a floor-side baseplate (12) and a column-side footplate (14), the footplate (14) being mounted rotatably on the baseplate (12) and being secured, with a vertical play, by means of an abutment (24) against being lifted off from the baseplate (12), and at least one clamping cylinder (42) actuated by pressure medium being provided in order to tension the footplate (14) against the abutment (24).

15 Claims, 3 Drawing Sheets

U.S. PATENT DOCUMENTS 3,388,700 A 6/1968 Mountz
3,868,103 A 2/1975 Pageot et al.
4,101,120 A 7/1978 Seshima
4,176,415 A 12/1979 Dickerson et al.
4,244,358 A 1/1981 Pyers
4,597,119 A 7/1986 Padgett
4,640,482 A 2/1987 Rogers
4,768,241 A 9/1988 Beney
5,031,547 A * 7/1991 Hirose ..... 108/140
5,083,331 A 1/1992 Schnelle et al.
5,220,698 A 6/1993 Hannant
5,277,427 A 1/1994 Bryan et al.
5,279,011 A 1/1994 Schnelle
5,477,570 A 12/1995 Hannant et al.
5,544,376 A 8/1996 Fromson
5,564,852 A 10/1996 Maxwell et al.
5,611,638 A 3/1997 Dorr et al.
5,615,431 A 4/1997 Vassilli
5,621,932 A 4/1997 Strachan
5,628,078 A 5/1997 Pennington et al.
5,649,833 A 7/1997 Pfeuffer et al.
5,651,150 A 7/1997 Kanitzer et al.
5,659,909 A 8/1997 Pfeuffer et al.
5,754,997 A 5/1998 Lussi et al.
5,769,720 A 6/1998 Aiken et al.
5,787,528 A 8/1998 Antinori
5,790,996 A 8/1998 Narfstrom
5,914,796 A 6/1999 Selin
5,969,488 A 10/1999 Fromson
6,008,598 A 12/1999 Luff et al.
6,038,718 A 3/2000 Pennington et al.
6,073,284 A 6/2000 Borders
6,095,713 A 8/2000 Doyle et al.
6,351,678 B1 2/2002 Borders
6,390,927 B1 5/2002 Cleveland, III
6,396,224 B1 5/2002 Luff et al.
6,484,334 B1 11/2002 Borders et al.
6,539,028 B1 3/2003 Soh et al.
6,560,492 B2 5/2003 Borders
6,565,156 B1 5/2003 Yamashita et al.
6,609,260 B2 8/2003 Hand et al.
6,619,872 B2 9/2003 Crorey et al.
6,634,202 B1 10/2003 Oetiker
6,722,289 B2 * 4/2004 Kato ..... 108/20
6,862,761 B2 3/2005 Hand et al.
6,971,131 B2 12/2005 Bannister
6,986,179 B2 * 1/2006 Varadharajulu et al. ..... 5/611
7,010,369 B2 3/2006 Borders et al.
7,068,143 B2 6/2006 Doering et al.
7,089,612 B2 8/2006 Rocher et al.
7,154,397 B2 12/2006 Zerhusen et al.
7,181,791 B2 2/2007 Clayton
7,210,201 B2 5/2007 Maekle et al.
7,235,942 B2 6/2007 Nagaoka et al.
7,321,811 B1 1/2008 Rawls-Meehan
7,346,944 B2 3/2008 Shaw
7,367,740 B2 5/2008 Lazic et al.
7,398,790 B2 7/2008 Glatz
7,412,736 B2 8/2008 Hyre et al.
7,526,823 B2 5/2009 Koch
7,634,826 B2 12/2009 Koch
7,669,258 B2 3/2010 Koch
7,694,366 B2 4/2010 Koch et al.
2002/0014951 A1 2/2002 Kramer et al.
2002/0111701 A1 8/2002 Borders
2002/0170115 A1 11/2002 Borders et al.
2003/0078144 A1 4/2003 Gehrke
2003/0090387 A1 5/2003 Lestienne et al.
2003/0195644 A1 10/2003 Borders et al.
2004/0006821 A1 1/2004 Hand et al.
2004/0074003 A1 * 4/2004 Bannister ..... 5/616
2004/0172757 A1 * 9/2004 Somasundaram ..... 5/601
2007/0056105 A1 3/2007 Hyre et al.
2007/0101500 A1 5/2007 Fruh et al.
2007/0107123 A1 5/2007 Koch
2007/0107124 A1 5/2007 Koch
2007/0107125 A1 5/2007 Koch
2007/0107126 A1 5/2007 Koch
2007/0107129 A1 5/2007 Burstner
2007/0110448 A1 5/2007 Ruch
2007/0116512 A1 5/2007 Katzenstein
2007/0118989 A1 5/2007 Koch
2009/0119842 A1 5/2009 Koch
2010/0107340 A1 5/2010 Koch et al.

FOREIGN PATENT DOCUMENTS

DE 4229318 C1 9/1993
DE 296 10 726 U1 9/1996
DE 19732467 A1 2/1999
DE 197 51 320 A1 5/1999
DE 19748367 A1 5/1999
DE 19751329 A1 5/1999
DE 19919496 A1 11/2000
DE 102 53 878 A1 5/2004
DE 102 53 906 A1 6/2004
EP 0 457 246 A1 11/1991
EP 0625348 A1 11/1994
EP 0832603 A1 4/1998
EP 0 913 139 A 5/1999
FR 2388546 11/1978
GB 1 321 193 6/1973
GB 2260075 A 4/1993
GB 2 277 870 A 11/1994
WO 99 28146 A1 6/1999
WO 02 055001 A1 7/2002
WO 03 086263 A1 10/2003

OTHER PUBLICATIONS

European Search Report for Application No. EP 06 12 3719, dated Sep. 7, 2007.
European Search Report for Application No. EP 06 12 3721, dated Jun. 20, 2008.
European Search Report for Serial No. EP 06 12 3598 dated Feb. 8, 2007.
European Search Report for Serial No. EP 06 12 3596 dated Sep. 7, 2007.
European Search Report for Serial No. EP 06 12 3592 dated Nov. 29, 2007.
European Search Report for Serial No. EP 06 12 3593 dated Dec. 4, 2007.
European Search Report for Serial No. EP 06 12 3443 dated Feb. 7, 2007.
V. Vitsas, et al., Performance Analysis of the Advanced Infrared (AIr) CSMA/CA MAC Protocol for Wireless LANs, Kluwer Academic Publishers, Wireless Networks 9, pp. 495-507.

* cited by examiner

HYDRAULIC COLUMN CLAMPING

CROSS REFERENCE TO RELATED APPLICATIONS

Applicant hereby claims foreign priority benefits under U.S.C. §119 from German Patent Application No. 10 2005 053 753.7 filed on Nov. 10, 2005, the contents of which are incorporated by reference herein.

FIELD OF THE INVENTION

The present invention relates to an operating table which comprises a table column with a column foot and with a column head and also a bed connectable or connected to the column head.

BACKGROUND OF THE INVENTION

In many operating tables of this kind, the bed is rotatable about the vertical longitudinal axis of the table column, in order to bring the bed into a suitable position, depending on the space requirement or on the type of surgical intervention to be carried out. The bed then has to be detained in this suitable position in terms of rotation about the vertical table-column axis.

A rotatability of the bed about the vertical table-column axis can be achieved, for example, in that a column-side portion of the column foot is mounted rotatably on a floor-side portion of the column foot, and the two portions of the column foot can then be clamped by means of a mechanical clamping mechanism in order to detain the position of the bed.

In mechanical clamping mechanisms, however, there is the problem that it is difficult to dimension the clamping force accurately. In mechanical clamping devices in which the clamping force is directly related to the mechanical adjustment of a clamping element, these clamping elements should be installed with only a very low installation tolerance, because a deviation of the installation position has a direct effect on the clamping force. Since both too low and too high a clamping force are to be avoided without fail, mechanical clamping devices must be produced with high precision and at an associated high outlay.

SUMMARY OF THE INVENTION

The object on which the invention is based is to specify an operating table of the type mentioned in the introduction, which makes it possible by simple means to detain the bed in terms of rotation about the longitudinal axis of the table column.

This object is achieved in that the column foot has a floor-side baseplate and a column-side footplate, in that the footplate is mounted rotatably on the baseplate and is secured, with a vertical play, by means of an abutment against being lifted off from the baseplate, and in that at least one pressure-actuated clamping cylinder is provided in order to clamp the footplate against the abutment.

In the operating table according to the invention, the clamping force is applied by means of a pressure-actuated clamping cylinder. This clamping force is therefore set via the pressure of the pressure fluid of the clamping cylinder, not via the dimensioning of a mechanical stroke travel or the like, so that the clamping force can be set simply and nevertheless accurately, without the installation tolerance having to meet particularly stringent requirements. Furthermore, there is increased freedom in constructing the column foot, because the pressure fluid can be conducted along any desired paths via suitable lines, so that contrary to a mechanical shaft, for example, lines of this type do not obstruct other components of the column foot.

Preferably, the clamping cylinder is arranged on the footplate and, when acted upon by the pressure medium, is supported on the baseplate.

In an advantageous embodiment, the abutment is formed by a circular ring which is connected to the baseplate and which surrounds the footplate and at least partially engages over the latter at its outer edge.

Preferably, the at least one clamping cylinder can be acted upon by pressure fluid via a foot-actuated pump. By means of a foot-actuated pump of this type, a sufficiently high clamping force can be produced with little effort.

In a particularly advantageous embodiment, the line between the pump and the clamping cylinder is connected to a tank for the pressure fluid via a pressure-limiting valve. This ensures that, irrespective of how vigorously the pump is actuated, the pressure of the pressure fluid which is introduced into the clamping cylinder does not overshoot a maximum pressure which is defined by the pressure-limiting valve. As a result, the clamping mechanism cannot be overloaded, and it is simple to set the clamping force according to the maximum pressure of the pressure-limiting valve.

BRIEF DESCRIPTION OF THE DRAWINGS

For a clearer understanding of the present invention, reference is made below to the preferred exemplary embodiment which is illustrated in the drawings and which is described by means of specific terminology. It may be pointed out, however, that the scope of protection of the invention is not to be restricted thereby, since such variations and further modifications to the device shown and such further applications of the invention as are indicated in it are considered to be the conventional current and future specialized knowledge of a competent person skilled in the art. An exemplary embodiment of the invention is shown in the figures in which, to be precise.

DETAILED DESCRIPTION OF THE INVENTION

Figure 1:
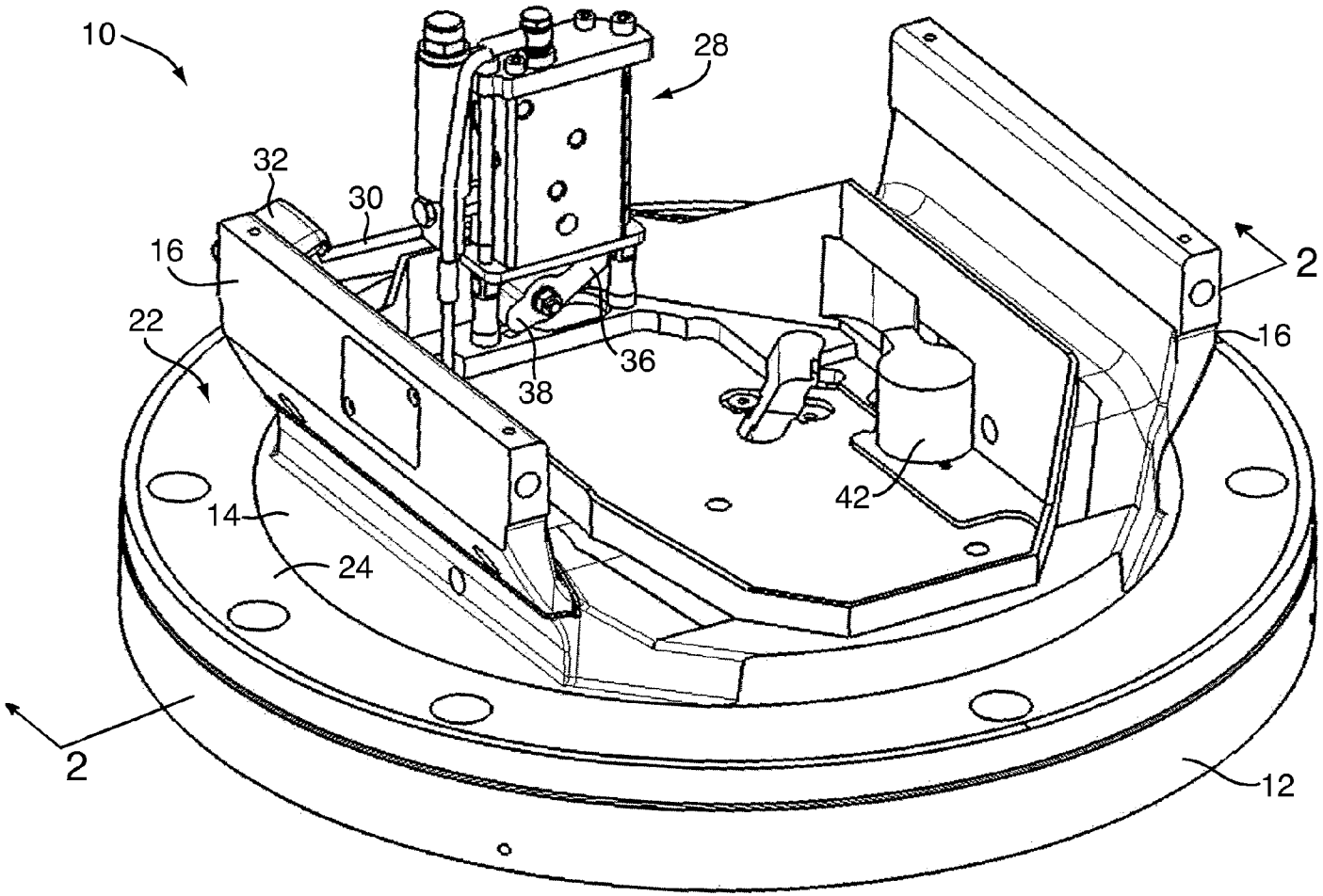
FIG. 1 shows a perspective view of a column foot.
Figure 2:
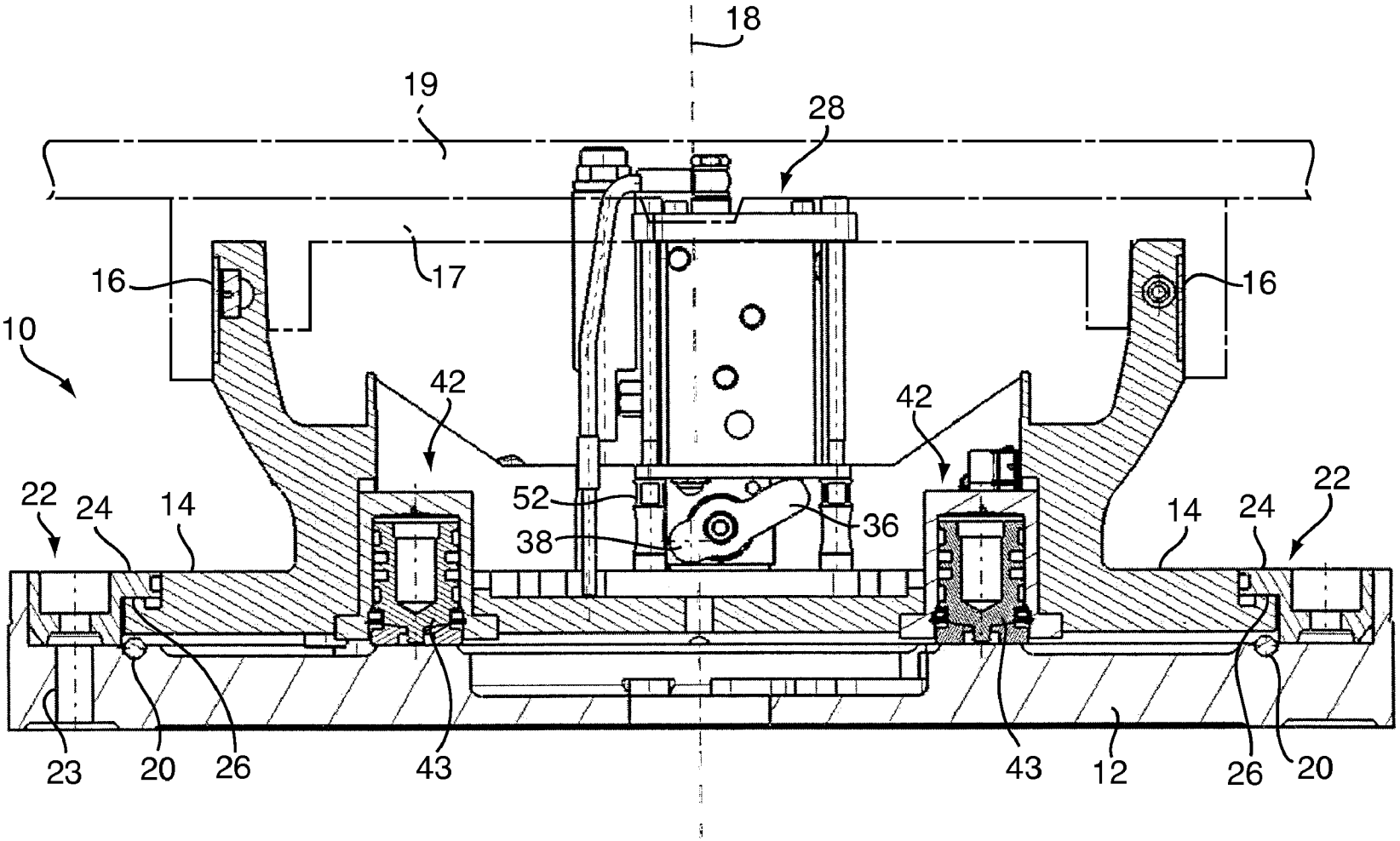
FIG. 2 shows a cross-sectional view of the column foot along the line 2-2 of FIG. 1.

FIG. 1 shows a column foot 10 for a table column of an operating table in a perspective view, and FIG. 2 shows the column foot 10 in a section along the line 2-2 of FIG. 1.

The column foot 10 comprises a floor-side baseplate 12 (see FIG. 2) and a column-side footplate 14. The footplate 14 is continued vertically upwards by a table-column portion 16. A column head 17 is supported on the table column 16 and a bed 19 is connectable or connected to the column head 17 as shown by phantom lines in FIG. 2.

The footplate 14 is mounted on the floor-side baseplate 12 rotatably about a vertical axis 18. The bearing is in this case formed by a ball raceway 20 which can be seen in the cross-sectional view of FIG. 2.

A circular ring 22 is fastened by means of bolts 23 to the floor-side baseplate 12. The circular ring 22 has an inwardly directed protuberance 24 which engages over the footplate 14 at its outer edge portion 26. The protuberance 24 of the circular ring 22 forms an abutment for the outer edge portion 26 of the baseplate 12, the said abutment preventing the footplate 14 from lifting off from the baseplate 12. Between the protuberance 24 of the circular ring 22 and the outer edge portion 26 of the baseplate 12, there is a vertical play, so that the footplate 14 can normally, that is to say when it is not clamped in the way described in more detail below, be rotated about the vertical axis 18, without being appreciably braked due to frictional contact with the protuberance 24.

Figure 3:
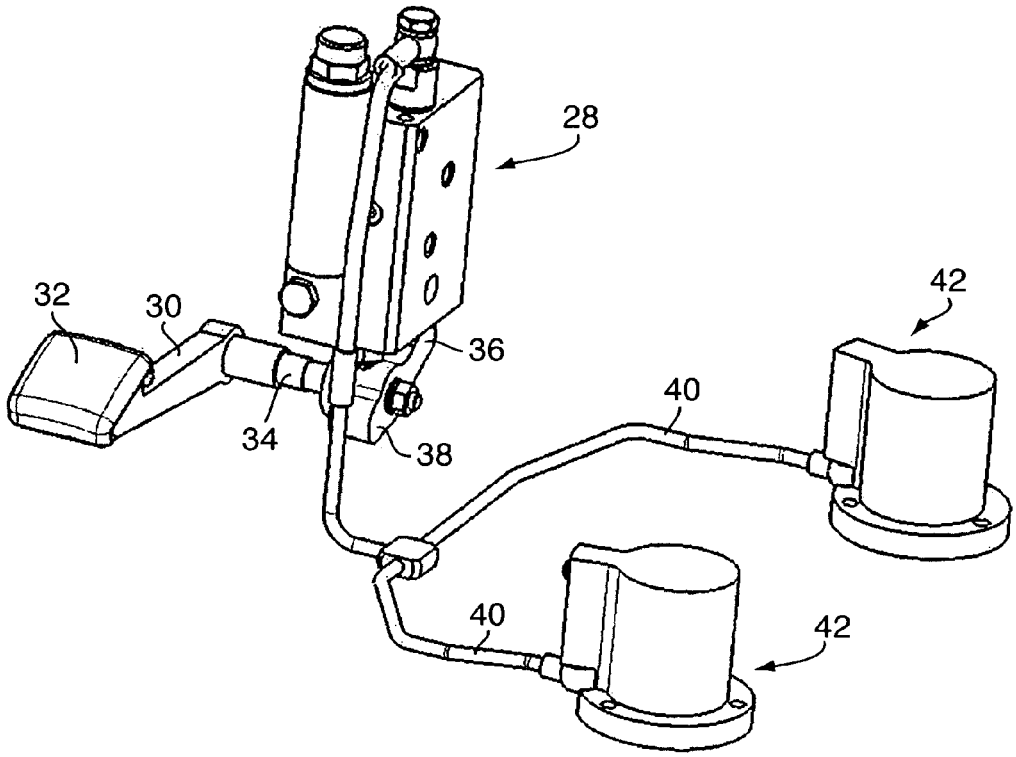
FIG. 3 shows a perspective view of a foot-actuated pump which is connected to two clamping cylinders.

Furthermore, a foot-actuated pump 28, which is illustrated separately in a perspective view in FIG. 3, is arranged on the footplate 14. As can be seen in FIG. 1 and FIG. 3, the pump 28 has a foot lever 30, on the end of which a foot pedal 32 is arranged. By the foot pedal 32 being depressed, a pump shaft 34 is rotated via the foot lever 30. As can be seen in FIGS. 1 to 3, a longer working cam 36 and a shorter release cam 38, the function of which is described below, are arranged at one end of the pump shaft 34.

The pump 28 is connected via hydraulic lines 40 to two hydraulic clamping cylinders 42 which are arranged on the footplate 14 (see FIG. 1 and FIG. 2).

The pump 28 and the hydraulic clamping cylinders 42 are connected via a hydraulic circuit which is illustrated diagrammatically in FIG. 4 and is described below together with the clamping function of the column foot 10.

In the non-clamped state, the footplate 14 can be rotated about the vertical axis 18 in relation to the baseplate 12, as mentioned above. A bed (not shown), which is fastened to a column head of the table column (not shown), can thereby be rotated into a suitable position. When the bed has been rotated into a suitable position, the footplate 14 is clamped to the baseplate 12, as follows, in order to detain the bed in terms of rotation about the vertical axis 18.

To clamp or lock the footplate 14, the foot pedal 32 of the foot lever 30 is depressed. As a result, the pump 28 is actuated via the working cam 36, and hydraulic oil is sucked in from a hydraulic-oil tank 44 (see FIG. 4) via a suction-intake valve 46. The hydraulic oil sucked in in this way is pumped via a non-return valve 48 and the hydraulic line 40 into the hydraulic clamping cylinders 42, of which the pistons 43 (see FIG. 2) are thereby extended and are supported on the baseplate 12. With increasing pressure in the hydraulic line 40, the footplate 14 is raised, with the result that it is tensioned with its outer edge portions 26 against the protuberance 24 of the circular ring 22. In this state, the footplate 14 is clamped to the circular-ring 22 and can no longer be rotated about the vertical axis 18.

The non-return valve 48 ensures that the pressure in the line 40 is maintained, even after pumping has ended, and the footplate 14 thus remains clamped to the baseplate 12 via the circular ring 22.

Figure 4:
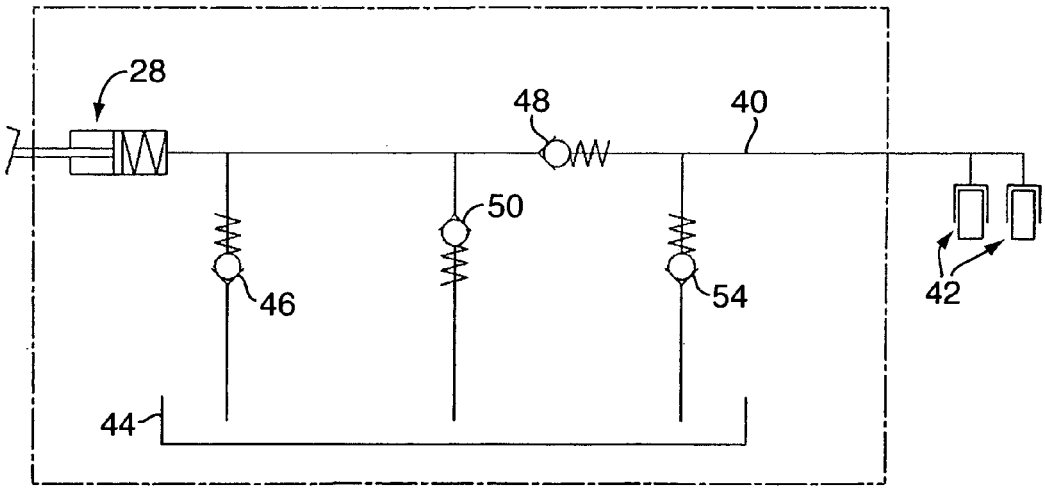
FIG. 4 shows a diagrammatic illustration of a hydraulic circuit.

As can be seen in FIG. 4, a relief valve or pressure-limiting valve 50 is arranged between the pump 28 and the non-return valve 48. This relief valve 50 is such that it opens to the hydraulic-oil tank 44 when the pressure between the pump 28 and the non-return valve 48 overshoots a predetermined maximum pressure. This ensures that the pressure in the line 40, which is supplied to the clamping cylinders 42, never overshoots this predetermined maximum pressure.

As a result of the above-described set-up with the relief valve 50, the footplate 14 is always clamped to the baseplate 12, independently of installation tolerances of the clamping cylinders 42, with a predetermined maximum clamping force which corresponds to the maximum pressure of the relief valve 50. What is ensured, in particular, is that the clamping mechanism is not overloaded by too high a clamping pressure.

To release the clamping connection between the baseplate 12 and the footplate 14, the foot pedal 32 (see FIG. 1 and FIG. 3) is lifted with the foot. The release cam 38 is thereby moved clockwise in the illustration of FIG. 2, until it butts against an actuating portion 52 (see FIG. 2) of a release valve 54 which connects the hydraulic line 40 to the hydraulic-oil tank 44 (see FIG. 4). When the release cam 38 butts against the actuating portion 52 of the release valve 54, the latter is opened, with the result that hydraulic oil escapes from the hydraulic line 40 into the hydraulic-oil tank 44 and the pressure acting upon the clamping cylinders 42 decreases. The pistons 43 of the clamping cylinders 42 are thereby retracted, the footplate 14 is lowered and the clamping action between the footplate 14 and baseplate 12 is cancelled.

In the embodiment of the column foot 10 which is shown, a high clamping action can be generated by means of low operating forces. The clamping mechanism is insensitive towards manufacturing and installation tolerances, since the system is not aimed at achieving a predetermined stroke travel of the pistons 43 of the clamping cylinders 42, but at achieving a maximum clamping pressure which can easily be produced with the aid of the relief valve 50. Finally, the hydraulic clamping system described here is distinguished by a small construction space, as compared with purely mechanical solutions conventional hitherto. The hydraulic oil can be conducted along any desired paths by means of the line 40, so that, contrary to a conventionally used mechanical shaft, for example, the lines 40 do not obstruct further components. In particular, the construction space between the two clamping cylinders 42 remains free.

Although a preferred exemplary embodiment has been shown and described in detail in the drawings and in the above description, this is to be considered as purely illustrative and not restrictive of the invention. It is pointed out that only the preferred exemplary embodiment is illustrated and described, and all variations and modifications which come at the present time and in future within the scope of protection of the invention are to be protected.

While the present invention has been illustrated and described with respect to a particular embodiment thereof, it should be appreciated by those of ordinary skill in the art that various modifications to this invention may be made without departing from the spirit and scope of the present invention.

What is claimed is:

1. An operating table, comprising a table column with a column foot and with a column head and also a bed connectable or connected to the column head, wherein the column foot has a floor side baseplate and a column side footplate, the footplate is mounted rotatably on the baseplate and is secured, with a vertical play, by means of an abutment against being lifted off from the baseplate, said table further comprising at least one pressure actuated clamping cylinder directly abutting the baseplate and actuable to clamp the footplate against the abutment.

2. The operating table according to claim 1, wherein the clamping cylinder is arranged on the footplate and, when acted upon by the pressure medium, is supported on the baseplate.

3. The operating table according to claim 1, wherein the abutment is formed by a circular ring which is connected to the baseplate and which surrounds the footplate and at least partially engages over the latter at its outer edge.

4. The operating table according to claim 1, wherein the at least one clamping cylinder is actuated by pressure fluid via a foot actuated pump.

5. The operating table according to claim 4, wherein a hydraulic line between the pump and the clamping cylinder is connected to a tank for the pressure fluid via a pressure limiting valve.

6. An operating table, comprising a table column with a column foot and with a column head and also a bed connectable or connected to the column head, wherein the column foot has a floor side baseplate and a column side footplate, the footplate is mounted rotatably on the baseplate and secured, with a vertical play, by means of an abutment against being lifted off from the baseplate, said table further comprising at least one pressure actuated clamping cylinder extensible to clamp the footplate upwardly against the abutment.

7. The operating table according to claim 6, wherein the clamping cylinder is arranged on the footplate and, when acted upon by the pressure medium, is supported on the baseplate.

8. The operating table according to claim 6, wherein the abutment is formed by a circular ring which is connected to the baseplate and which surrounds the footplate and at least partially engages over the latter at its outer edge.

9. The operating table according to claim 6, wherein the at least one clamping cylinder is actuated by pressure fluid via a foot actuated pump.

10. The operating table according to claim 9, wherein a hydraulic line between the pump and the clamping cylinder is connected to a tank for the pressure fluid via a pressure limiting valve.

11. An operating table, comprising a table column with a column foot and with a column head and also a bed connectable or connected to the column head, wherein the column foot has a floor side baseplate and a column side footplate, the footplate is mounted rotatably on the baseplate and secured, with a vertical play, by means of an abutment against being lifted off from the baseplate, said table further comprising at least one pressure actuated clamping cylinder directly mounted on the footplate and actuable to clamp the footplate against the abutment.

12. The operating table according to claim 11, wherein the clamping cylinder is arranged on the footplate and, when acted upon by the pressure medium, is supported on the baseplate.

13. The operating table according to claim 11, wherein the abutment is formed by a circular ring which is connected to the baseplate and which surrounds the footplate and at least partially engages over the latter at its outer edge.

14. The operating table according to claim 11, wherein the at least one clamping cylinder is actuated by pressure fluid via a foot actuated pump.

15. The operating table according to claim 14, wherein a hydraulic line between the pump and the clamping cylinder is connected to a tank for the pressure fluid via a pressure limiting valve.

* * * * *